US005175481A

United States Patent [19]

Kanno

[11] Patent Number: 5,175,481

[45] Date of Patent: Dec. 29, 1992

[54] ADJUSTING DEVICE FOR A REMOTE CONTROL SYSTEM

[75] Inventor: Isao Kanno, Hamamatsu, Japan

[73] Assignee: Sanshin Kogyo Kabushiki Kaisha, Hamamatsu, Japan

[21] Appl. No.: 741,308

[22] Filed: Aug. 7, 1991

[30] Foreign Application Priority Data

Aug. 10, 1990 [JP] Japan ..... 2-210229

[51] Int. Cl.[5] ..... B63H 25/00

[52] U.S. Cl. ..... 318/588; 318/652

[58] Field of Search ..... 318/16, 568.17, 580, 318/581, 588, 628, 685, 696, 663, 652; 226/15; 340/825.05, 825.14, 825.29

[56] References Cited

U.S. PATENT DOCUMENTS

| | | | |
|---|---|---|---|
| 4,223,624 | 9/1980 | Iyeta | 318/588 |
| 4,306,314 | 12/1981 | Griffiths . | |
| 4,513,235 | 4/1985 | Acklam et al. | 318/685 X |
| 4,824,408 | 4/1989 | Aertker et al. | 318/16 |
| 4,914,368 | 4/1990 | Orton | 318/663 |
| 5,058,793 | 10/1991 | Neville et al. | 226/15 |
| 5,072,361 | 12/1991 | Davis et al. | 318/568.17 |

*Primary Examiner*—A. Jonathan Wysocki
*Attorney, Agent, or Firm*—Ernest A. Beutler

[57] ABSTRACT

An adjusting device embodied in a remote control system which adjusts the output potential characteristics of one or more of the system's detector's relative to their associated inputs and/or relative to each other to improve the motion transmissibility of cables in the system. The system includes a movable operator and a first detector which detects the position of the operator through a first transmitter that interconnects the operator and first detector. A controller element, responsive to movement of the operator, is connected by way of a second transmitter to a second detector which detects the position of the second transmitter and hence, the controlled element. The connection point of the first transmitter to the first detector may be selectively adjusted to vary the angular movement of the first detector relative to a given input produced on the first transmitter by the operator. Similarly, the angular movement of the second detector may be selectively varied relative to a given input produced on the second transmitter by an electric actuator connected to the controlled element by selectively adjusting the connection point of the second transmitter to the second detector.

10 Claims, 7 Drawing Sheets

ADJUSTING DEVICE FOR A REMOTE CONTROL SYSTEM

BACKGROUND OF THE INVENTION

This invention relates to a remote control system adapted for a marine propulsion unit, and more particularly to an improved remote control system which includes a remote operator for actuating a controlled element through an electric actuator unit, and a detecting arrangement including detectors for detecting the position of the operator transmitting means and the position of the transmitting means associated with the controlled element wherein the output characteristics of a detector may be adjusted relative to its corresponding input or relative to the other detector.

One type of remote control arrangement has been proposed which is employed on certain water craft to electrically operate a controlled member on an associated marine propulsion unit. With this type of arrangement, movement of a remote operator effects movement of the controlled member through an electric actuator which is powered by a storage battery on the water craft. A detection-control system is provided which controls the actuator so that the detected position of the remote operator and controlled member normally correspond. This type of arrangement has certain advantages. For example, this arrangement does not require the use of cables extending the entire length between the remote operator and the controlled member and therefore has the advantage of reducing the operational load normally associated with purely mechanically operated remote control systems. However, this arrangement has certain disadvantages associated with it as well. For example, it is usually through a cable that the actuator is connected to the controlled member, or through a cable that the operator or actuator is linked to the detection system. With repeated use, these cables are apt to exhibit some poor transmissibility which may be caused by their resistance against bending or dimensional errors such as too much "play" in the system. This may, in turn, result in insufficient shift strokes and may impose certain limitations with respect to cable arrangements.

It is, therefore, a principal object of this invention to provide a remote control system for a marine propulsion unit which improves the transmissibility of the cables and the actuation of the controlled member of the system.

It is another object of this invention to provide an improved remote control system which includes a remote operator, an actuator for actuating a controlled element in response to movement of the operator, and a detecting arrangement wherein the detection output characteristics of the position detector associated with the controlled element transmitting means is adjusted relative to its input.

It is a further object of this invention to provide an improved remote control system which includes a remote operator, an actuator for actuating a controlled element in response to movement of the operator, and a detecting arrangement wherein the detection output characteristics of the operator transmitting means position detector is adjusted relative to its input.

It is yet another object of this invention to provide an improved remote control system which includes a remote operator, an actuator for actuating a controlled element in response to movement of the operator, and a detecting arrangement wherein the detection output characteristics of the operator and controlled element transmitting means position detectors are adjusted relative to their respective inputs and relative to each other.

SUMMARY OF THE INVENTION

This invention is adapted to be embodied in a remote control system for transmitting control movement to a controlled element and which includes a remote control unit having an operator movable between a plurality of positions. The system further includes first means for detecting the position of the operator and outputting a signal to a controlling unit indicative of the detected position of the operator, as well as second means for detecting the position of transmitting means connected to the controlled element and outputting a signal to the controlling unit indicative of the detected position of the transmitting means. Electric actuating means are provided for actuating the controlled element and producing an input on the transmitting means on the basis of the signals received by the controlling unit. In accordance with the invention, the remote control system includes means for adjusting the output characteristics of the second detecting means relative to the input.

Another feature of this invention is also adapted to be embodied in a remote control system for transmitting control movement to a controlled element and which includes a remote control unit having transmitting means and an operator movable between a plurality of positions for producing an input on the transmitting means. The system further includes first means for detecting the position of the transmitting means and outputting a signal to a controlling unit indicative of the detected position of the transmitting means, as well as second means for detecting the position of the controlled element and outputting a signal to the controlling unit indicative of the detected position of the controlled element. Electric actuating means are provided for actuating the controlled element on the basis of the signals received by the controlling unit. In accordance with this feature of the invention, the remote control system further includes means for adjusting the output characteristics of the first detecting means relative to the input.

A further feature of the invention is also adapted for use in a remote control system for transmitting control movement to a controlled element comprising, a remote control unit having first transmitting means and an operator movable between a plurality of positions for producing a first input on the first transmitting means. In accordance with this feature of the invention, there is provided first means for detecting the position of the first transmitting means and outputting a signal to a controlling unit indicative of the detected position of the first transmitting means. This feature further includes second transmitting means connected to the controlled element, and second means for detecting the position of the second transmitting means and outputting a signal to the controlling unit indicative of the detected position of the second transmitting means. Electric actuating means are provided for actuating the controlled element and producing a second input on the second transmitting means on the basis of the signals received by the controlling unit. There is further provided means for adjusting the output characteristics of at least one of the detecting means relative to its associated input. The adjusting means may adjust both detecting means relative to their respective inputs and relative to each other.

DETAILED DESCRIPTION OF THE PREFERRED EMBODIMENTS OF THE INVENTION

Figure 1:
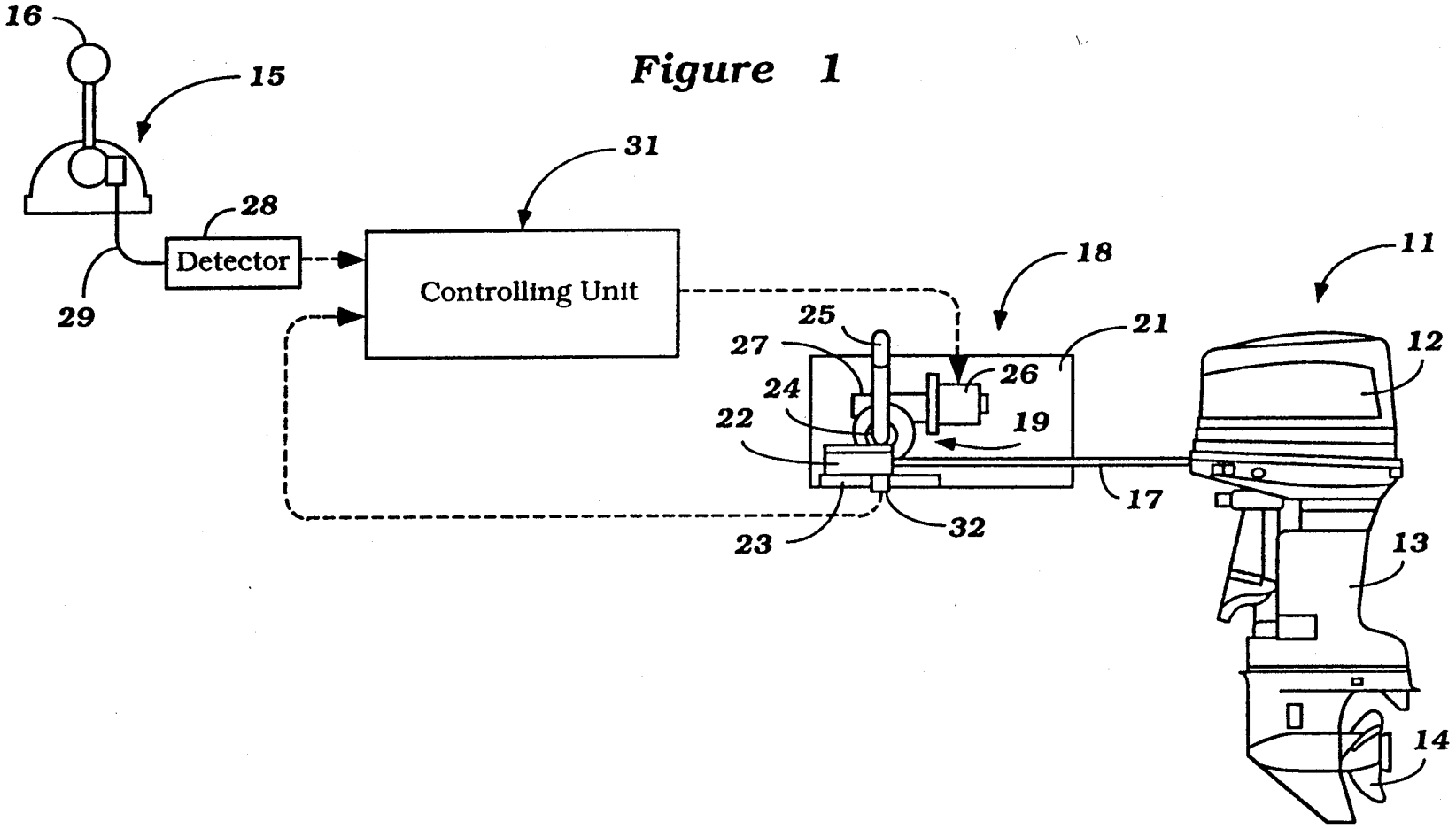
FIG. 1 is a partially perspective and partially schematic view of the remote control system constructed and operated in accordance with embodiments of the invention.

Referring first to FIG. 1, a remote control system for operating a marine propulsion unit from a remote location is depicted. In the illustrated embodiment, the marine propulsion unit, which is identified generally by the reference numeral 11, comprises an outboard motor. However, it should be noted that the marine propulsion unit 11 may alternatively comprise the outboard drive portion of an inboard/outboard drive unit.

In the illustrated embodiment, the marine propulsion unit 11 includes a power head 12 that contains an internal combustion engine (not shown) and which is surrounded by a protective cowling. The internal combustion engine drives an output shaft which, in turn, drives a driveshaft that is journaled for rotation within a driveshaft housing 13 that depends from the power head 12. This driveshaft (not shown) drives a propeller 14 of a lower unit by means of a conventional forward, neutral, reverse transmission of the type normally used with such propulsion units and which may be operated in accordance with embodiments of the invention.

A remote control unit 15, comprised of an operator 16 pivotally mounted on a base, is provided for controlling either a throttle or transmission control lever on the marine propulsion unit 11 and is preferably positioned near the other controls of the associated water craft. If the remote control unit 15 is used to control throttle operation, the operator 16 will be movable between an idle position and a fully open throttle position. If, on the other hand, the remote control unit 15 is used to control the transmission, the operator 16 will be movable between neutral, forward and reverse positions. The remote control unit 15 may also be adapted to control both the transmission and throttle of the propulsion unit 11. In the illustrated embodiment, the remote unit 15 is used to control either transmission or throttle operation of the propulsion unit 11.

A cable 17 is connected at one end to the throttle or transmission control lever and is connected at the other end to an electromotive actuator unit 18 for actuation of the lever. This actuator unit 18 comprises electric actuating means 19 for controlling movement of the lever and thus for controlling the throttling or transmission of the marine propulsion unit 11. The actuator unit 18 and its associated components are contained within a casing 21.

Figure 2:
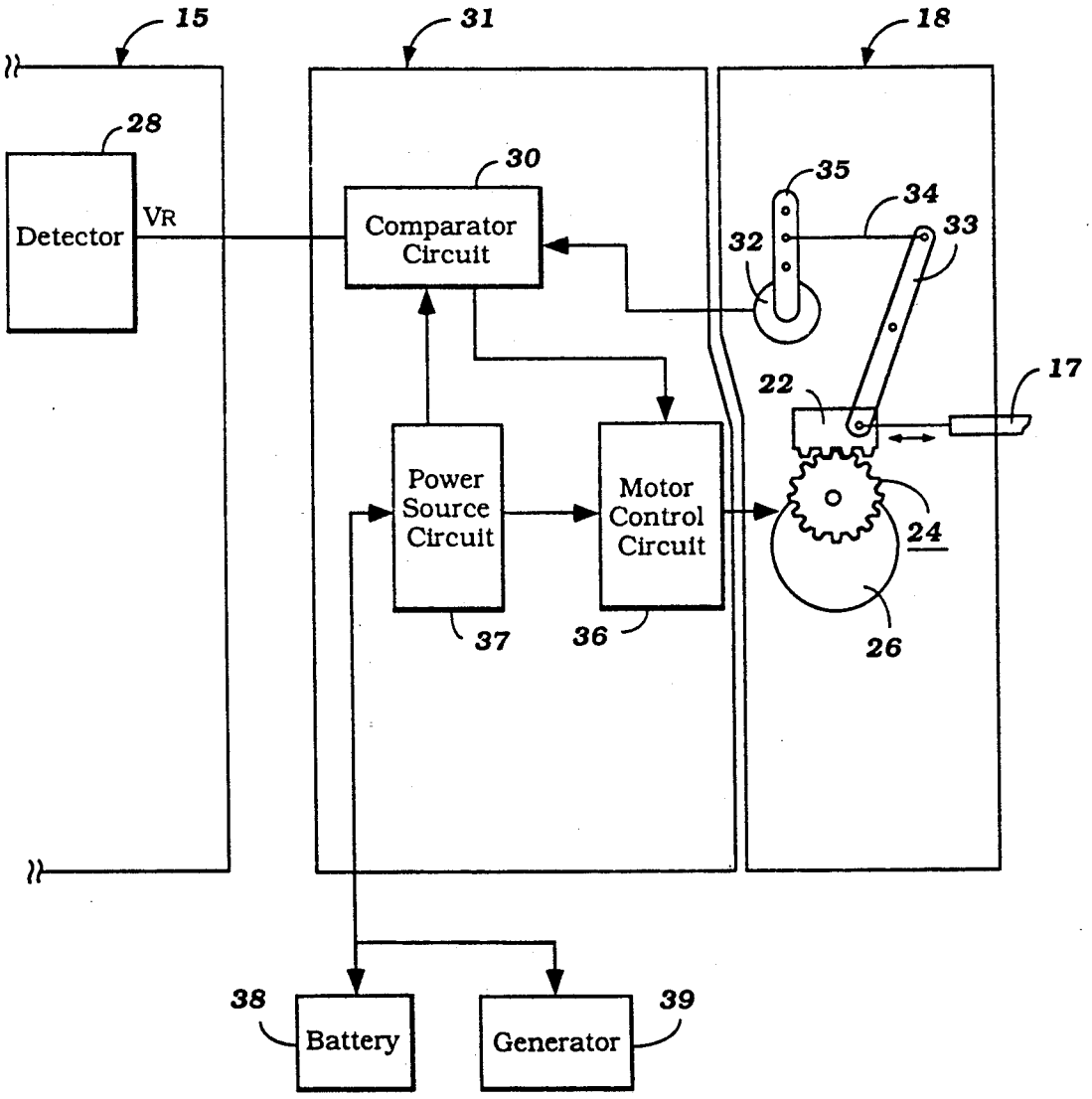
FIG. 2 is a schematic view of the remote control system showing the actuator unit and the controlling unit and a portion of the remote control unit.

Referring now to FIG. 2, in addition to FIG. 1, the cable 17 has a bowden wire which is connected at one end to the control lever and at its other end to a slide rack 22 which is slidably supported on a base 23 and which together with the control lever form the controlled element. The rack 22 has teeth that are enmeshed with a pinion gear 24 which is rotatably journaled upon a shaft and which is also journaled to a manual lever 25. An electric motor 26 is coupled to the shaft through a reduction gear box assembly 27 and is operated to drive the shaft and effect movement of the control lever on the propulsion unit 11 under normal conditions and in a manner to be described.

When the electric actuating means 19 is used to control movement of the throttle or transmission control lever, a control position detector 28, connected to the operator 16 through a transmitting means 29, detects the movement of the transmitting means 29 as the operator 16 is moved to determine the position of the operator 16. The detector 28 is preferably comprised of a potentiometer and an arm that is mounted for pivotal movement on the detector body and which is connected to the transmitting means 29 which is preferably a cable.

After detecting the position or movement of the cable 29, the control position detector 28 then transmits an electrical signal indicative of this detected position to a comparator circuit 30 of a controlling unit, indicated generally by the reference numeral 31. In accordance with a feature of the invention, the detector 28 further includes means for adjusting its detection output characteristics as hereinafter described.

Figure 3A:
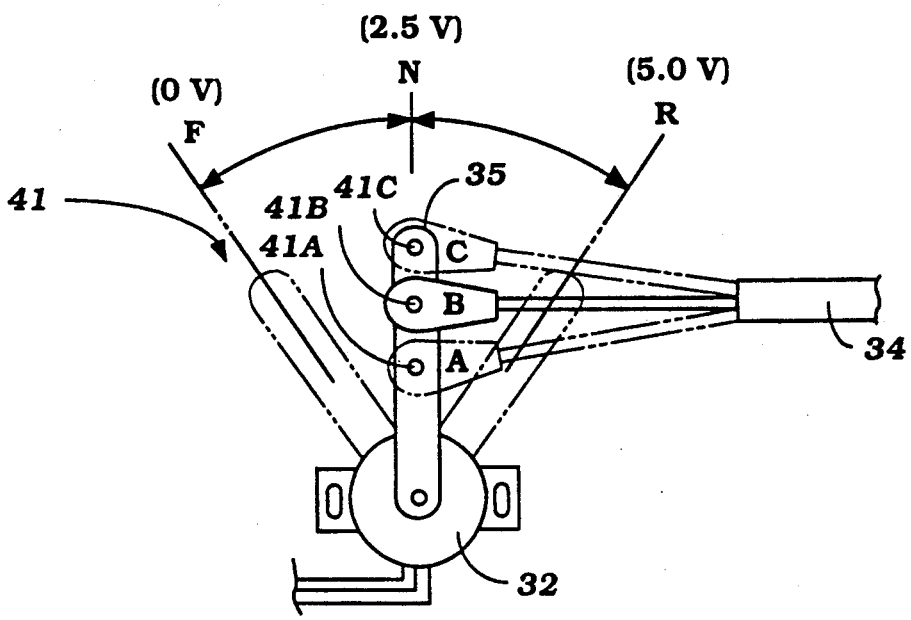
FIG. 3A shows a first embodiment of the detection output characteristic adjusting means in connection with the controlled element transmitting means position detector.

Upon movement of the operator 16 and cable 29, this comparator circuit 30 also receives an electrical signal from a detector 32 also of the potentiometer type which detects the position of the slide rack 22 through angular movement of a link 33 which is pivotally connected to the slide rack 22 at one end and connected at the other end to a transmitting means preferably in the form of a cable 34. This cable 34 is connected at its other end to an arm 35 that is pivotally mounted to the body of the detector 32. As a result of this connection, movement of the slide rack 22 causes the link 33 to pivot to exert either a pushing or pulling force on the cable 34 so that the arm 35 of the detector 32 pivots as shown in FIG. 3A. The electrical signal outputted by the detector 32 is indicative of the detected position or movement of the cable 34, which provides an indication of the position of the slide rack 22 and thus the position of the throttle or transmission control lever on the propulsion unit 11 which, as previously noted, is mechanically linked to the slide rack 22 via the cable assembly 17. In accordance with another feature of the invention, this detector 32 also includes means for adjusting its output characteristics as hereinafter described.

In operation, the comparator circuit 30 compares the signals received from the detectors 28 and 32 and outputs a difference signal to a motor control circuit 36 which, in turn, outputs a signal to the electric motor 26 for controlling its operation to null the difference signal. That is, upon receipt of this difference signal, the electric motor 26 is operated so that the present position of the slide rack 22 and hence the transmission or throttle control lever corresponds with the present position of the operator 16.

When the motor 26 is operated in this manner under normal conditions, it drives the shaft and pinion gear 24. Movement of the pinion gear 24 causes the slide rack 22 to slide along its base 23 to effect a push-pull movement on the bowden wire of cable 17 so as to effect movement of the transmission or throttle control lever until the position of the lever corresponds with the position of the operator 16. When the pinion gear 24 and manual lever 25 are engaged with the shaft, as is the case in the electric actuating mode, the manual lever 25 will also move in response to operation of the electric motor 26 and shaft so as to give a visual indication of the position of the throttle or transmission control lever.

A power source circuit 37 of the controlling unit 31 provides power to the comparator circuit 30 and to the motor control circuit 36. The power source circuit 37 is in circuit with a battery 38 and a generator 39 equipped on the engine.

Figure 3B:
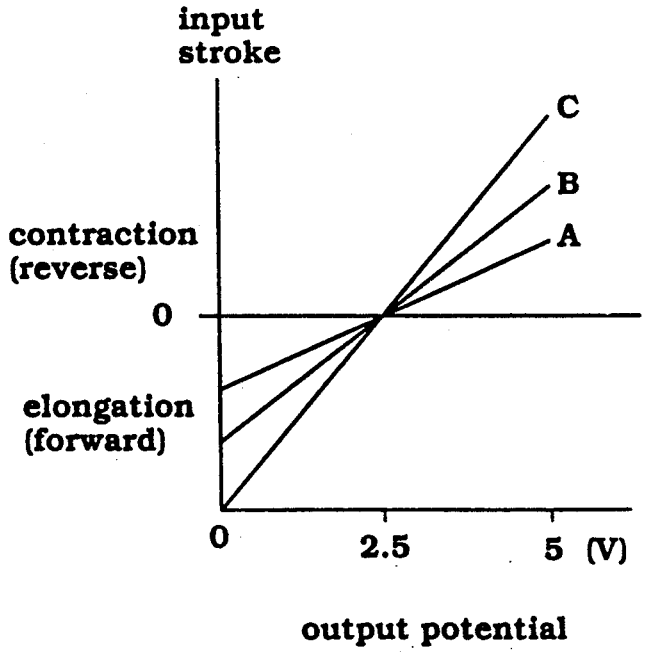
FIG. 3B shows the relationship between the output potential of that detector and its associated input stroke for different connection points.

Referring now to FIG. 3A, a first embodiment of the means for adjusting the output characteristics of the detector 32 is illustrated. This adjusting means, indicated generally by the reference numeral 41, includes a series of three (3) apertures 41A, 41B and 41C which are formed in the arm 35 of the detector 32 and which correspond to respective points A, B and C of connection for the cable 34. The cable 34 is selectively connected to one of these apertures 41A, 41B or 41C so as to obtain the desired output potential characteristics for the detector 32 relative to its input stroke generated by the motor 26, as indicated by the lines A, B and C in the graph of FIG. 3B. By changing the point of connection of the cable 34 to the arm 35 using the apertures 41A, 41B and 41C, as shown in FIG. 3A, the output potential of the detector 32 measured in volts may be altered for a given input stroke as depicted in FIG. 3B. Conversely, changing the connection point of the cable 34 to arm 35 between apertures 41A, 41B and 41C also changes the size of the electric motor input stroke required for the detector 32 to produce a given change in output voltage.

Figure 4:
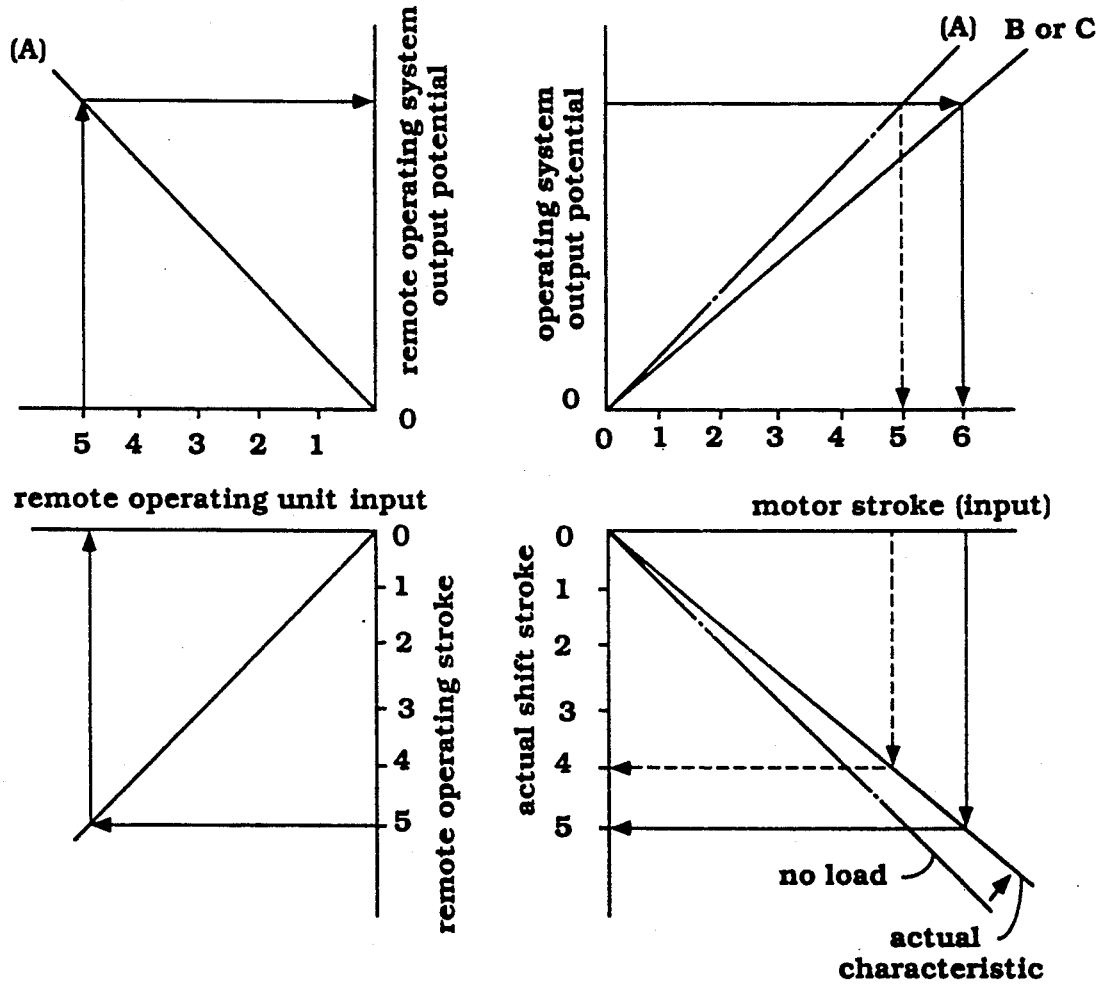
FIG. 4 graphically illustrates an example of how the relatively poor transmitting efficiency caused by resistance of the cable connecting the slide rack with the lever on the propulsion unit may be revised.
Figure 5:
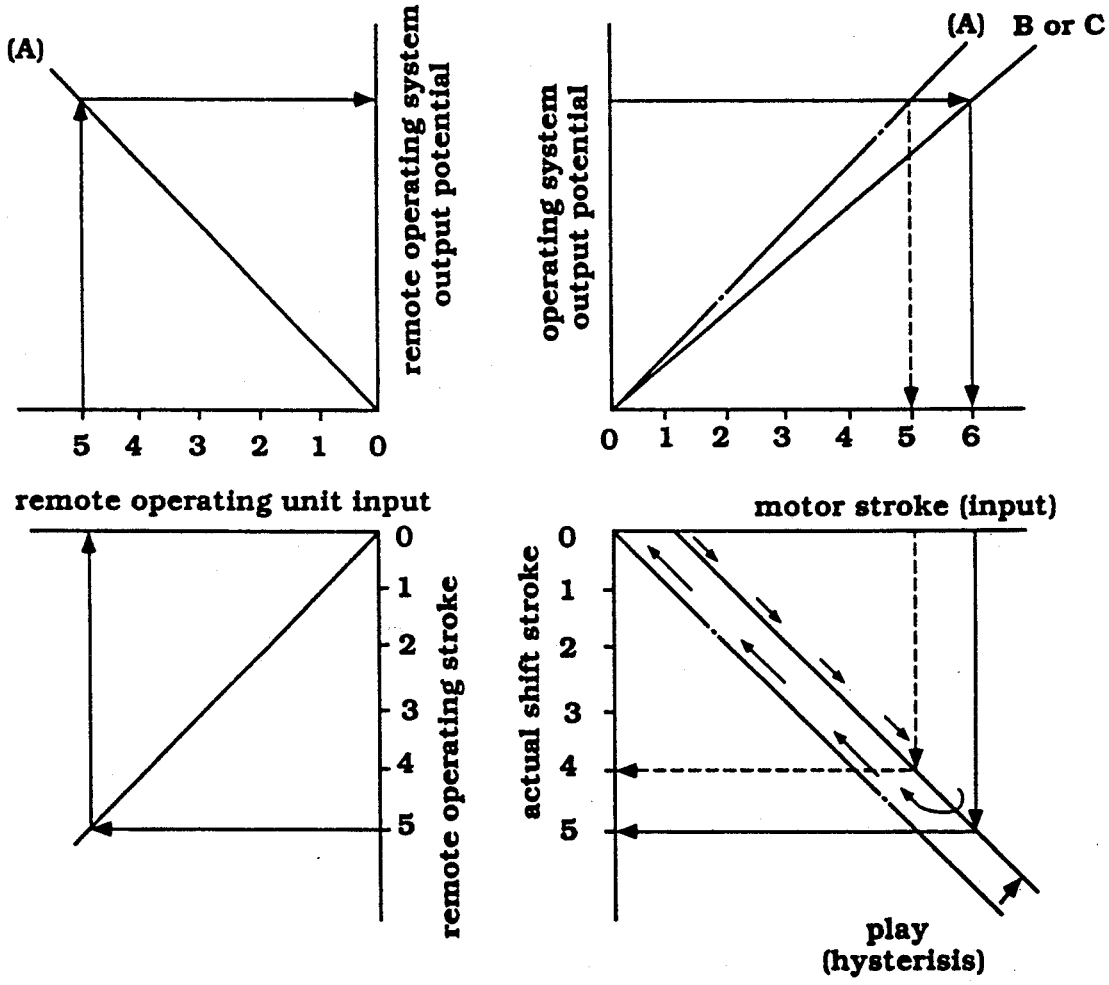
FIG. 5 graphically illustrates an example of how the relatively poor transmitting efficiency caused by an unstable cable with too much "play" between the slide rack and the lever on the propulsion unit may be revised.

FIGS. 4 and 5 graphically illustrate how the relatively poor transmitting efficiency of cable 17 caused by resistance or too much "play" may be improved using the adjusting means 41.

For example, as shown in FIG. 4, when the cable 34 is connected to the arm 35 at point A, a remote operating stroke of five exerted on the operator 16 gives a remote operating unit input of five on cable 29 which results in a certain output voltage being produced by the detector 28. To equalize the output voltages produced by the detectors 28 and 32, there is a motor input stroke of five which under a no load condition would produce an actual shift stroke of the throttle or transmission control lever of five. However, the actual shift stroke under actual conditions with the cable 17 exhibiting some resistance will be somewhat less, for example only four.

To improve the transmissibility of the cable 17 in this situation, the connection of cable 34 is moved further away from the pivot point of the arm 35 on the body of the detector 32. For example, the connection of cable 34 is changed from point A to point B or C. With this arrangement, the same remote operating stroke of five will result in the same remote operating unit input and the same output voltage being produced by the detector 28. However, a larger motor input stroke of six will be required for the detector 32 to produce the same output potential to null the output potential produced by the detector 28. This larger motor input stroke, in turn, results in a larger actual shift stroke of the throttle or transmission control lever under actual conditions of five.

FIG. 5 graphically shows the relatively poor transmissibility of cable 17 in an unstable state when the cable 34 is connected to the arm 35 at point A. In this case, a remote operating stroke of five exerted on the operator 16 gives a remote operating unit input of five on cable 29 which results in a certain output voltage being produced by the detector 28. To equalize the output voltages produced by the detectors 28 and 32, a motor input stroke of five is initiated which under ideal conditions should produce an actual shift stroke of the throttle or transmission control lever of five. However, when the cable 17 is unstable and there is too much "play" in it, the true shift stroke will be somewhat less, for example only four.

To improve the transmissibility of the cable 17 in this case, the connection of cable 34 is changed to a point further away from the pivot point of the arm 35 on the body of the detector 32, for example, from point A to point B or C. When this is done, the same remote operating stroke of five will result in the same remote operating unit input and the same output voltage being produced by the detector 28. However, a larger motor input stroke of six will be required for the detector 32 to produce the same output potential to null the output potential produced by the detector 28. This results in a larger actual shift stroke of the throttle or transmission control lever in this case of five.

Figure 6:
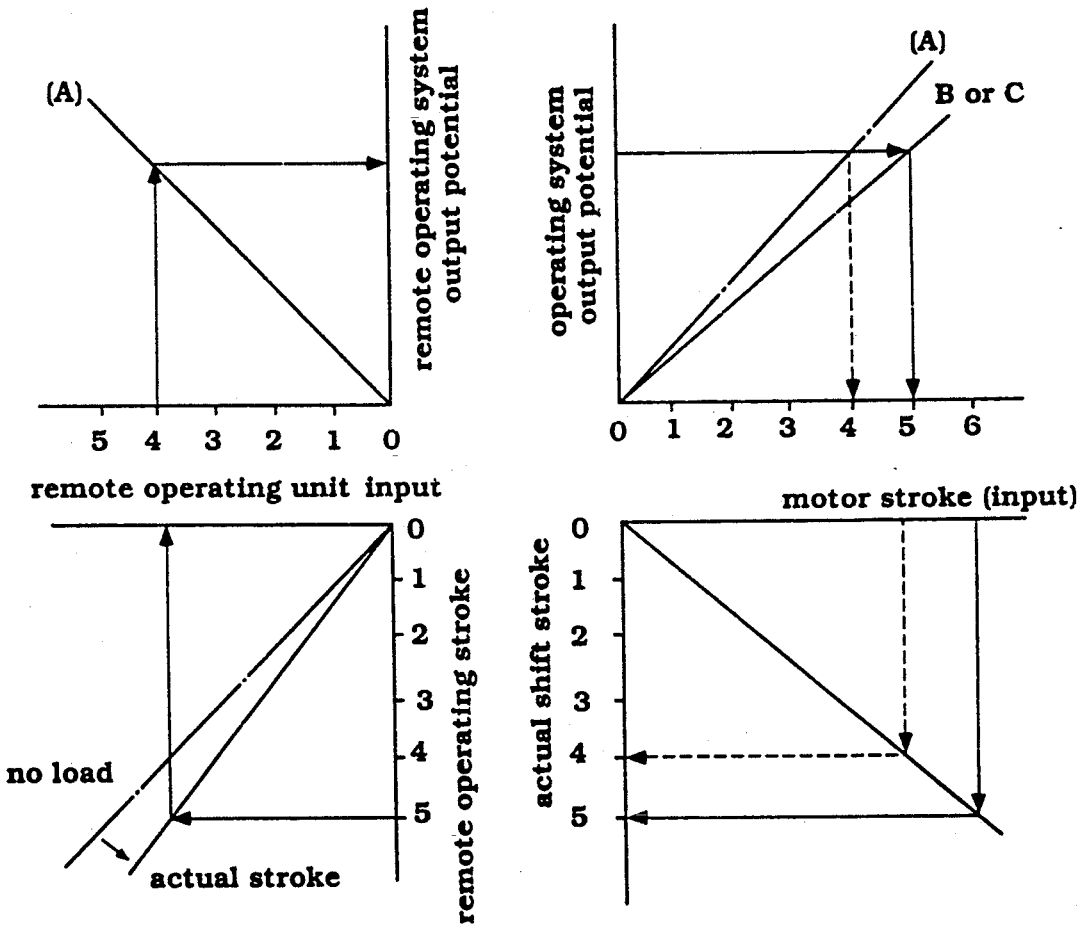
FIG. 6 graphically illustrates an example of how the relatively poor transmitting efficiency caused by resistance of the cable connecting the operator with its associated detector may be revised.

Referring now to FIG. 6, a set of graphs illustrate how the relatively poor transmitting efficiency of cable 29 caused by resistance may be improved using the adjusting means 41. A remote operating stroke on the operator 16 of five under no load conditions should result in a remote operating unit input on cable 29 of five. However, when the cable 29 is exhibiting resistance, its input will be less, i.e., only four, causing the detector 28 to generate a lower output voltage. When the connection of cable 34 to the arm 35 is changed from point A to point B or C in this situation, a motor input stroke of five instead of four will be required to null the output potential generated by detector 28. This results in an actual shift stroke of the lever on the propulsion unit 11 of five instead of four.

Figure 7A:
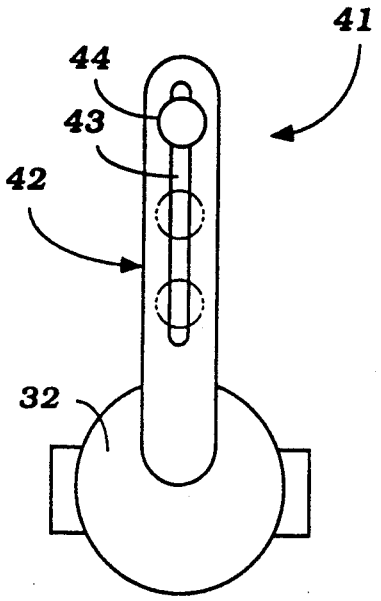
FIGS. 7A and 7B show a second embodiment of the detector output characteristic adjusting means.
Figure 7B:
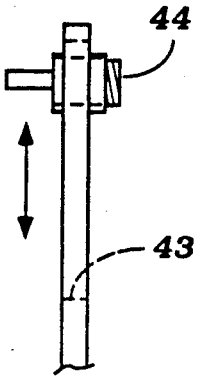

FIGS. 7A and 7B illustrate a second embodiment of the invention, wherein the adjusting means includes an arm 42 which is pivotally attached to the detector 32 and which is formed with a slot 43. A sleeve and set screw assembly 44 is slidably moveable within the slot 43 and may be secured at a desired point along the slot 43 by tightening the set screw. The assembly 44 is provided with a connection for the cable 34 at its end opposite the set screw. Thus, as with the first embodiment, the point of connection of the cable 34 to the arm 42 of detector 32 may be adjusted to alter the output potential characteristics of the detector 32.

Figure 8:
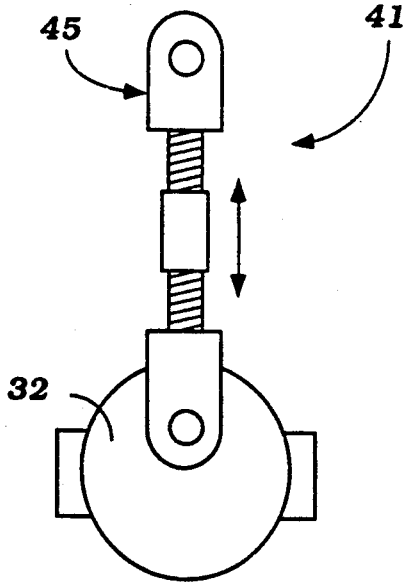
FIG. 8 shows a third embodiment of the detector output characteristic adjusting means.

FIG. 8 shows a third embodiment of the invention, wherein the adjusting means 41 comprises a multiple piece arm 45. The lower arm piece is pivotally mounted on the detector 32 and includes a threaded screw portion at its upper end. The upper arm piece is connected at its upper end to the cable 34 and includes a threaded screw portion at its lower end that is adapted to be joined with the threaded screw portion of the lower arm piece by means of a threaded sleeve. With this construction, the threaded sleeve may be rotated to vary the point of connection between the cable 34 and arm 45 relative to the point of connection between the arm 45 and the detector 32 and thereby adjust the output potential characteristics of the detector 32.

It should be noted that constructions similar to those used in the embodiments described above may be used in conjunction with the detector 28. With this detector 28, however, it is the cable 29 which would be selectively connected to the arm of detector 28 at different locations to alter the output potential of the detector 28 for a given input stroke of the operator 16, or to vary the size of the input stroke required for the detector 28 to generate a given output voltage.

From the foregoing description it should be readily apparent that the described remote control system is extremely effective in obtaining improved motion transmissibility of cables in the system without unduly limiting the cable arrangement. The arrangements also permit the sensitivity of the system to be adjusted to suit the individual operating the system. Although embodiments of the invention have been illustrated and described, various changes and modifications may be made without departing from the spirit and scope of the invention, as defined by the appended claims.

I claim:

1. A remote control system for transmitting control movement to a controlled element comprising, a controlling unit, a remote control unit having an operator movable between a plurality of positions, first means for detecting the position of said operator and outputting a signal to said controlling unit indicative of the detected position of said operator, transmitting means connected to said controlled element, second means, connected to said transmitting means and angularly movable, for detecting the position of said transmitting means and outputting a signal to said controlling unit indicative of the detected position of said transmitting means, electric actuating means for actuating said controlled element and producing an input on said transmitting means on the basis of the signals received by said controlling unit, and means for selectively varying the angular movement of said second detecting means relative to a given input for adjusting the output characteristics of said second detecting means relative to the input.

2. A remote control system as recited in claim 1, wherein said adjusting means adjusts the output characteristics of said second detecting means relative to said first detecting means.

3. A remote control system as recited in claim 1, wherein each of said detecting means comprise a potentiometer.

4. A remote control system as recited in claim 1, wherein said controlling unit comprises a comparator for comparing the signals received from said first and second detecting means and outputting a difference signal to said electric actuating means for controlling its operation to null the difference signal.

5. A remote control system for transmitting control movement to a controlled element comprising, a controlling unit, a remote control unit having transmitting means and an operator movable between a plurality of positions for producing an input on said transmitting means, first means for detecting the position of said transmitting means and outputting a signal to said controlling unit indicative of the detected position of said transmitting means, second means, connected to said transmitting means and angularly movable, for detecting the position of said controlled element and outputting a signal to said controlling unit indicative of the detected position of said controlled element, electric actuating means for actuating said controlled element on the basis of the signals received by said controlling unit, and means for selectively varying the angular movement of said second detecting means relative to a given input for adjusting the output characteristics of said first detecting means relative to the input.

6. A remote control system for transmitting control movement to a controlled element comprising, a controlling unit, a remote control unit having first transmitting means and an operator movable between a plurality of positions for producing a first input on said first transmitting means, first means, connected to said first transmitting means and angularly movable, for detecting the position of said first transmitting means and outputting a signal to said controlling unit indicative of the detected position of said first transmitting means, second transmitting means connected to said controlled element, second means, connected to said second transmitting means and angularly movable, for detecting the position of said second transmitting means and outputting a signal to said controlling unit indicative of the detected position of said second transmitting means, electric actuating means for actuating said controlled element and producing a second input on said second transmitting means on the basis of the signals received by said controlling unit, and means for selectively varying the angular movement of at least one of said detecting means relative to a given associated input for adjusting the output characteristics of at least one of said detecting means relative to its associated input.

7. A remote control system as recited in claim 6, wherein said adjusting means comprises means for adjusting the output characteristics of both of said detecting means relative to their associated inputs.

8. A remote control system as recited in claim 7, wherein the output characteristics of said detecting means are adjusted relative to each other.

9. A remote control system as recited in claim 6, wherein each of said detecting means comprise a potentiometer.

10. A remote control system as recited in claim 6, wherein said controlling unit comprises a comparator for comparing the signals received from said first and second detecting means and outputting a difference signal to said electric actuating means for controlling its operation to null the difference signal.

* * * * *